US005775597A

United States Patent [19]

Kleinberger

[11] Patent Number: 5,775,597

[45] Date of Patent: Jul. 7, 1998

[54] FIVE-SIDED FEED LINE FOR A MISTING SYSTEM

[76] Inventor: Itamar C. Kleinberger, 4367 Dunmore Rd., Marietta, Ga. 30068

[21] Appl. No.: 603,559

[22] Filed: Feb. 21, 1996

[51] Int. Cl.[6] ..... B05B 1/14

[52] U.S. Cl. ..... 239/550; 239/557; 239/562

[58] Field of Search ..... 239/550, 551, 239/556, 557, 562, 99; 138/177, 178, DIG. 11; 99/485, 516; 312/115

[56] References Cited

U.S. PATENT DOCUMENTS

| | | | |
|---|---|---|---|
| 2,228,076 | 1/1941 | Flavin | 138/DIG. 11 X |
| 2,625,806 | 1/1953 | Kennedy | 312/115 X |
| 3,320,964 | 5/1967 | Tripp | 312/115 X |
| 4,179,900 | 12/1979 | Corrigan | 62/231 |
| 4,808,303 | 2/1989 | Edwards et al. | 210/138 |
| 4,808,767 | 2/1989 | Colbachini | 174/47 |
| 4,914,339 | 4/1990 | Hayman, Jr. et al. | 312/115 |
| 4,923,258 | 5/1990 | Styles | 312/115 |
| 4,925,097 | 5/1990 | Corrigan | 239/562 |
| 5,651,502 | 7/1997 | Edwards | 239/550 X |

FOREIGN PATENT DOCUMENTS

| | | | |
|---|---|---|---|
| 2-240489 | 9/1990 | Japan | 138/177 |

OTHER PUBLICATIONS

"Hydromist Friendlier Misting Systems" advertising brochure (date unknown).

"Corrigan Single Deck Misting" advertising brochure (1993).

"Vege Mist VM-5000 Automatic Misting Systems" advertising brochure (date unknown).

*Primary Examiner*—Lesley D. Morris

*Attorney, Agent, or Firm*—Needle & Rosenberg, P.C.

[57] ABSTRACT

A misting system having a supply of a fluid, a feed line in fluid communication with the supply of the fluid, and at least one spray nozzle in fluid communication with fluid in the feed line for dispensing a fluid spray, wherein at least a portion of the exterior surface of the fed line is five-sided. Preferably, at least a position of each of four sides is perpendicular to the adjacent side and the fifth side is intermediate two of these sides to form an obtuse angle at the intersection thereof. The five-sided feed line of the present invention can be mounted so that it presents either a "square" or a "triangular" appearance so that the present invention provides an aesthetically-pleasing feed line that can be mounted to give two different appearances. The misting system also uses a first solenoid valve to spray intermittently and a second solenoid valve to decrease the pressure in the system after each spray cycle and to back-flush the system filter.

15 Claims, 4 Drawing Sheets

FIVE-SIDED FEED LINE FOR A MISTING SYSTEM

BACKGROUND OF THE INVENTION

1. Field of the Invention

This invention relates to a conduit for containing and directing a fluid and, more particularly, to a feed line having five sides for a misting system.

2. Background Art

Studies have shown that a high-moisture environment maintains certain items, such as fresh produce in a grocery store, longer and in a better condition. However, the shelf life of these products would be shorter if saturated with moisture. Thus, these products are sprayed periodically with a water mist.

One prior art method involved manually spraying the produce with water periodically throughout the day. It is now common to use a misting system permanently installed in the produce counter. A misting system includes a water supply, a feed line running along the counter for directing the water therethrough, a plurality of nozzles spaced along the feed line for spraying the produce, and a solenoid or other similar device connected to a timer to cause the spray to occur intermittently.

The currently available systems have problems in their operation. Most of the problems are caused by the feed line in the misting system. One prior art structure is the Corrigan™ system, which is disclosed in U.S. Pat. No. 4,179,900. The commercial embodiment of this apparatus consists of a white plastic circular tube having a 0.54 inch outer diameter and 0.28 inch inner diameter. The tube is 17⅛ inches long and has an O-ring at each end. Each spray station consists of a plastic "tee." The spray head, which includes the spray nozzles, is screwed into the middle section of the tee and the ends of the plastic tubes are inserted within each end of the tee. The juncture between the end of the tee and the adjoining end of the tube is held together by friction. An O-ring disposed therebetween provides a water seal. A problem with this design, however, is the small inner diameter causes a large pressure drop across the system. Thus, the head loss across the system causes different pressures at each tee section, thereby causing different spray patterns between one end of the system and the other end. To overcome this problem, these misting systems have incorporated an auxiliary pump to boost the pressure of the system, multiple supply ports used along the pipe, very short spray cycles, or a combination of these remedies. Another disadvantage of this system is that the circular feed pipe hanging in the produce case is unattractive. Furthermore, ultra violet ("UV") light can penetrate through the walls of the pipe and, as a result, allow the growth of algae inside the pipe to occur.

Another prior art system is the Vege Mist™ system that consists of an extruded plastic tubing having an inner diameter of 0.56 inches. The cross section of this tubing is basically circular but one side is elongated so that there is ample surface to introduce a ¼ inch pipe thread to which the spray head screws into. The opposite side of the extrusion has flat "ears" that are about 1½ inches across and are used for mounting purposes. This prior art system also has drawbacks. For example, it is hard to connect the segments because the person installing the system has to make a female thread at each end and then, using a threaded coupler, continue screwing the segments to each other. If there is a leak at one connection, it is difficult to fix. And, as with the Corrigan™ system, algae can grow inside the feed line.

Still another prior art system is the Hydro Mist™ system. This prior art is similar to the Corrigan™ system, but uses copper pipe to which the copper tees are soldered. This system is unattractive because it consists of bare tubing, is hard to fix if there is a leak, and is labor intensive to manufacture.

The Fractel™ system is disclosed in U.S. Pat. No. 4,808,303. This system has disadvantages because it is labor intensive to construct, expensive to detect and fix a leak, and dirt and bacteria accumulate in the pipe using the disclosed design.

U.S. Pat. No. 4,914,339 discloses another system, known as the KES™ system. The inventor of the present invention was a co-inventor of the subject matter in U.S. Pat. No. 4,914,339, which is hereby incorporated by reference. The KES™ system consists of a square or round tube having a colored outer layer and a black inner layer. This two-layer system is designed to prevent UV light from penetrating to the water, which inhibits the growth of algae. The adjoining sections of the system are coupled by gluing couplers to the outer surface of the tube. A problem with the rectangular tubing is that the stresses from the water pressure distribution within the tubing causes a high incidence of cracking in the corners. Thus, the wall thickness must be considerably thicker than for a circular design. In addition, it is difficult to join abutting segments of rectangular tubing effectively using rectangular adaptors, so there is a high occurrence of leaks, especially in the corners of the adaptors.

Thus, there is a need in the art for a system that is aesthetically pleasing, yet still overcomes the drawbacks of the systems in the prior art. Also, a system is needed that minimizes the head loss. Still further, the system also must inhibit the growth of algae and prevent the accumulation of dirt or bacteria, particularly in the feed line.

There is also a need in the art to have a system in which the feed line is thin to reduce manufacturing costs, but still does not leak. In the prior art systems, a feed line having a circular cross section handles the stresses of the water pressure best. But, consumers consider systems with a plain, circular exterior unattractive. Thus, there is a need in the art to use a feed line having an interior circular cross section for engineering considerations, but which has a more aesthetically pleasing exterior.

Yet another need in the art is to have a system in which the exterior of the feed line presents different appearances, depending upon the manner that the feed line is mounted. An associated need in the art is to be able to mount the spray nozzles from the feed line in different positions, depending upon the mounting position of the feed line. In particular, it is desired to mount the spray nozzles in positions other than downwardly depending, which is the method of mounting for most of the prior art systems.

Still another need in the art is a system in which the pressure of the misting system is bled off during periods of non-use to prevent leaks in any misting system. This prevents the system from leaking and dripping. Yet another need in the art is to allow back flushing the filter in the system continuously during operation, thus avoiding the need to shut down the system and manually clean the filter.

SUMMARY OF THE INVETION

The above disadvantages of the prior art are overcome by the present invention which provides a misting system having a supply of a fluid, a feed line in fluid communication with the supply of the fluid, and at least one spray nozzle in fluid communication with fluid in the feed line for dispensing a fluid spray. At least a portion of the exterior surface of the feed line is five-sided, preferably having one mounting side and four display sides. At least a portion of each of the four display sides is perpendicular to the adjacent display side. The mounting side is intermediate two of the display sides so that the two opposing ends of the mounting side terminate into the adjacent display side to form an obtuse angle therebetween.

The five-sided feed line of the present invention can be mounted so that it presents either a "square" or a "triangular" appearance. The spray nozzles on the feed line mounted to resemble a "square" can be disposed in a downwardly depending position or in a forwardly or a rearwardly extending position. If the spray nozzle is mounted in the forward position, it is less likely that spray from the spray nozzle would contact a mirror on the back of a conventional supermarket produce case in which the misting system is used.

As with the square appearance, the triangular appearance of the spray nozzle can be mounted in the forwardly or the rearwardly extending position. When the feed line of the present invention is mounted along the middle of an "island case" (stand alone case) or along the back side of a case that has no vertically-extending back wall, it has an advantage over prior art systems because the nozzles are disposed in the feed line at a forty-five degree (45°) angle relative to the mounting side so that the spray nozzles can be positioned over the area that is to be misted. Other prior art systems cannot have spray nozzles positioned over the desired area to be sprayed as the present invention does.

Thus, the present invention provides an aesthetically-pleasing feed line that can be mounted to give two different appearances. The user of the present invention has discretion to change the mounting of the feed line to provide a desired appearance. The attractive appearance of the feed line and associated misting system will potentially increase sales of the products being sprayed by it.

The feed line of the present invention also uses a circular internal diameter that is large enough to reduce the head loss. However, the material used in constructing the feed line is thick enough or of a color that UV light does not reach the water therein, thus preventing the growth of algae.

The present invention also encompasses a means for controlling the flow of the fluid to the misting system, thereby rendering an intermittent spray. The controlling means is designed to bleed off the pressure after each use, which prevents the spray nozzles from leaking. The method of bleeding off the pressure also backflushes the filter, thus avoiding the need to shut down the misting system frequently to clean the filter.

Furthermore, the present invention is easy to construct, which reduces installation costs. The present invention is also preferably designed to interface with components, such as elbows and tees, that are standard in the industry. This further helps reduce the cost of the present invention.

DETAILED DESCRIPTION OF THE INVENTION

The present invention is more particularly described in the following examples which are intended as illustrative only since numerous modifications and variations therein will be apparent to those skilled in the art. As used in the specification and in the claims, "a" can mean one or more, depending upon the context in which it is used.

Figure 1:
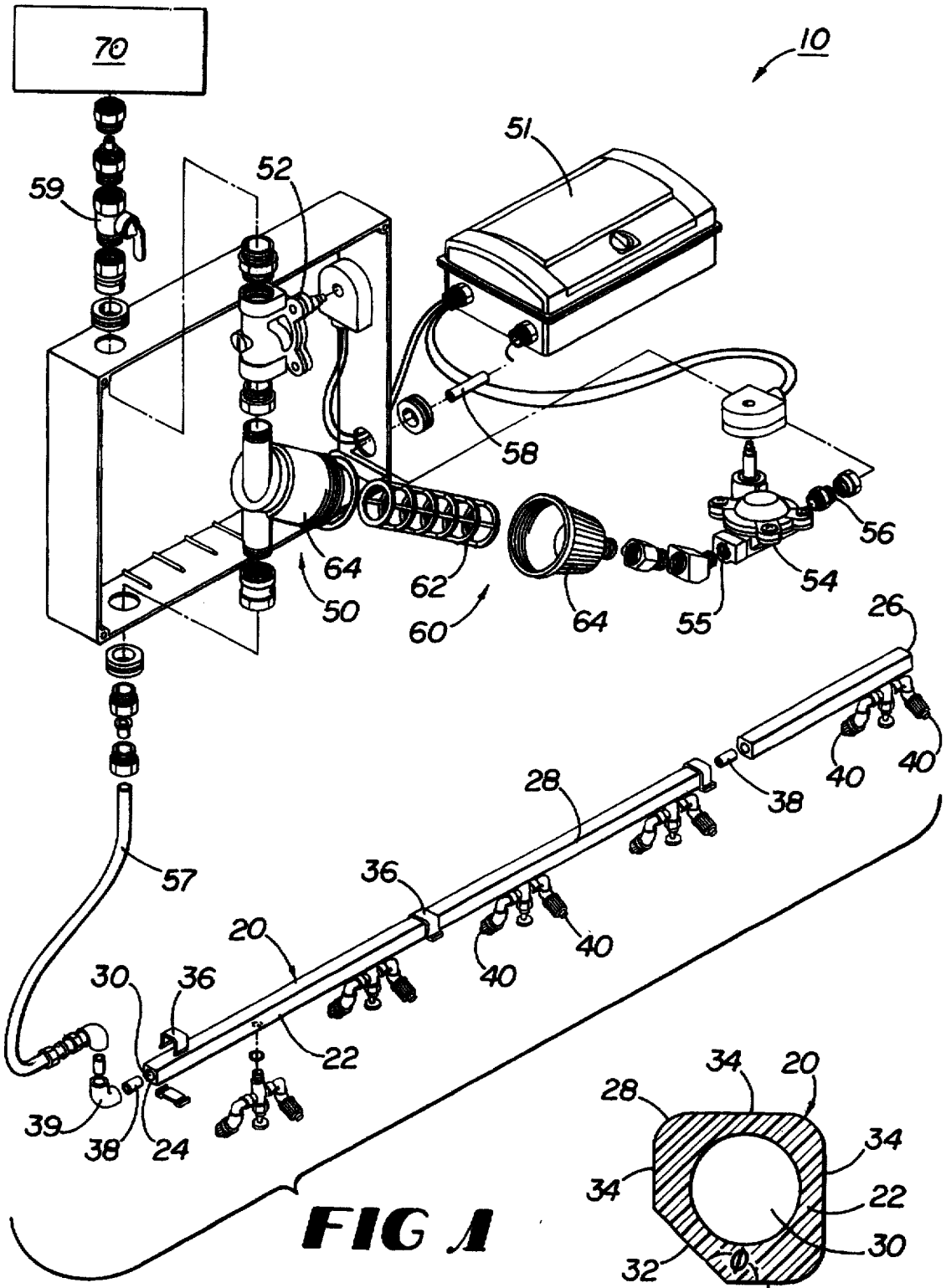
FIG. 1 is an exploded perspective view, in partially schematic form, of the present invention.

Referring generally to FIGS. 1–7, the present invention encompasses a misting system 10 comprising a supply 70 of a fluid (usually water), a feed line 20 in fluid communication with the supply 70 of the fluid, and at least one spray nozzle 40 in fluid communication with the feed line 20. The misting system 10 of the present invention can further comprise a means 50 for controlling the fluid flowing through the feed line 20 so that the fluid sprays from the misting system 10 intermittently. As shown in FIG. 1, the controlling means 50 is disposed intermediate the supply 70 of the fluid and the feed line 20. The supply 70 of the fluid is preferably a conventional water supply, such as that which exists in a grocery store. It is, of course, understood that the misting system 10 can be utilized in any situation wherein a mist or spray of fluid needs to be delivered to a product, such as in the seafood case in a grocery store, in a greenhouse, in a poultry house, or in a system used to mist people to cool them down.

The feed line 20 has a hollow body portion 22 having a first end 24 in fluid communication with the supply 70 of the fluid, an opposite second end 26, and an exterior surface 28. In the present invention, at least a portion of the exterior surface 28 is five-sided. The body portion 22 also defines a longitudinally-extending bore 30 through which the fluid flows. The second end 26 of the feed line 20 can be closed.

The feed line 20 is preferably made of polyvinyl chloride ("PVC" ) in a desired color, such as black, white, or light green. It is desired that the feed line 20 inhibit UV light penetration into the bore 30 because if the UV light reaches the fluid therein, the growth of algae can occur. Prevention of UV light penetration may be achieved by altering the thickness or the color of the feed line 20. The feed line 20 can be made of a single layer of a desired color or, alternatively, of two layers in which the inner layer is black and the thin outer layer is a desired color.

Figure 2:
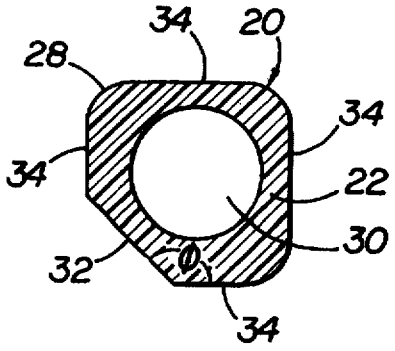
FIG. 2 is a side cross-sectional view of one embodiment of the feed line of the present invention.

Although it can use other shapes, it is preferred that the bore 30 of the feed line 20 is circular, as shown in FIG. 2, for various reasons. First, the fluid pressure of the misting system 10 is evenly distributed within a circular bore 30. Use of tubing having a square or rectangular interior cross section has a high rate of cracking in the corners. Thus, tubing with a non-circular cross section has to be considerably thicker than a circular one, which accordingly increases manufacturing costs. Using a circular bore 30 having a relatively large diameter also reduces the water pressure drop across the system, which results in a better and more uniform fluid spray along the misting system 10.

Another advantage of using a circular bore 30 is that if the diameter of the bore 30 is equivalent to a standard off-the-shelf chlorinated polyvinyl chloride ("CPVC") tubing diameter, then the manufacturing costs and construction costs of the misting system 10 of the present invention are reduced. In the preferred embodiment, the bore 30 is preferably 0.625 inches, which corresponds to a standard CPVC tube dimension. Thus, standard parts, such as elbows or tees, can be used instead of requiring unique fittings as in prior art systems.

Connections between portions of the feed line 20 having a circular bore 30—as opposed to another shape—can easily be made. However, one problem in extruding a feed line 20 of the present invention is that it is difficult to form a perfectly circular bore 30 because the feed line 20 has different wall thicknesses at different points, as shown in FIG. 2. Thus, creating a water-tight seal between two adjacent sections of the feed line 20 is difficult. A CPVC connector 38, as shown in FIG. 1, can be used having an outer diameter that is the same as the inner diameter of the bore 30. In addition, an O-ring (not shown) is preferably disposed at the center of the connector 38. A glue that will bond the feed line 20 made of PVC to the CPVC connector 38, such as an off-the-shelf product designed for this purpose, is placed on the outside surface of one side of the connector 38 and it is then placed inside of the bore 30 until the end of the section of the feed line 20 is adjacent to the O-ring in the center of the connector 38. The process is repeated for the other side of the connector 38. The glue melts part of the feed line 20 and connector 38 so that they seal together. The O-ring ensures that the seal is water-tight because of irregularities that may exist in the circular bore 30. Since the connectors 38 are disposed inside the feed line 20, the misting system 10 of the present invention is more attractive than prior art systems in which the connectors are disposed on the external surface of the feed line, such as the feed line disclosed in U.S. Pat. No. 4,914,339. The connector 38 can also be used to connect the feed line 20 to an elbow 39 or other component.

Referring generally to FIGS. 3–6, the spray nozzle 40 has a fluid receiving end 42 in fluid communication with fluid in the bore 30 of the feed line 20 and a fluid dispensing end 44 through which the fluid sprays therefrom. The body portion 22 of the feed line 20 has at least one opening from the exterior surface 28 into the bore 30 in which the fluid receiving end 42 of the spray nozzle 40 is disposed so that it is in fluid communication with the fluid within the bore 30. It is also preferred that the spray nozzle 40 has a filter screen (not shown) to prevent clogging with foreign material.

Instead of having a single spray nozzle 40 disposed in the opening in the feed line 20, it is preferred to use a spray station 45, which is also known as a nozzle assembly. The spray station 45 consists of at least two spray nozzles 40. The spray station 45 can also have an extension 48 and a valve stem 46 that can be used to throttle the volume and pressure of water that reaches the spray nozzles 40. The spray station 45 also preferably includes filter screens (not shown) and an internal ball and spring (not shown) that operates as a check valve to prevent water dripping below a certain water pressure. The spray nozzle 40, the spray station 45, or extension 48 may be mounted into the opening in the feed line 20 in any manner known in the art.

Referring back to FIG. 2, the five-sided exterior surface 28 of the feed line 20 preferably comprises one mounting side 32 and four display sides 34. At least a portion of each of the four display sides 34 is perpendicular to the adjacent display side 34. The mounting side 32 is intermediate two of the display sides 34. The mounting side 32 has two opposing ends so that each end of the mounting side 32 terminates into the adjacent display side 34 to form an obtuse angle $\phi$ therebetween. Alternatively, the five-sided exterior surface 28 of the feed line 20 can comprise five sides forming two acute and three obtuse angles therebetween, three acute and two obtuse angles therebetween, two obtuse and three right angles therebetween, or any combination thereof.

Figure 3:
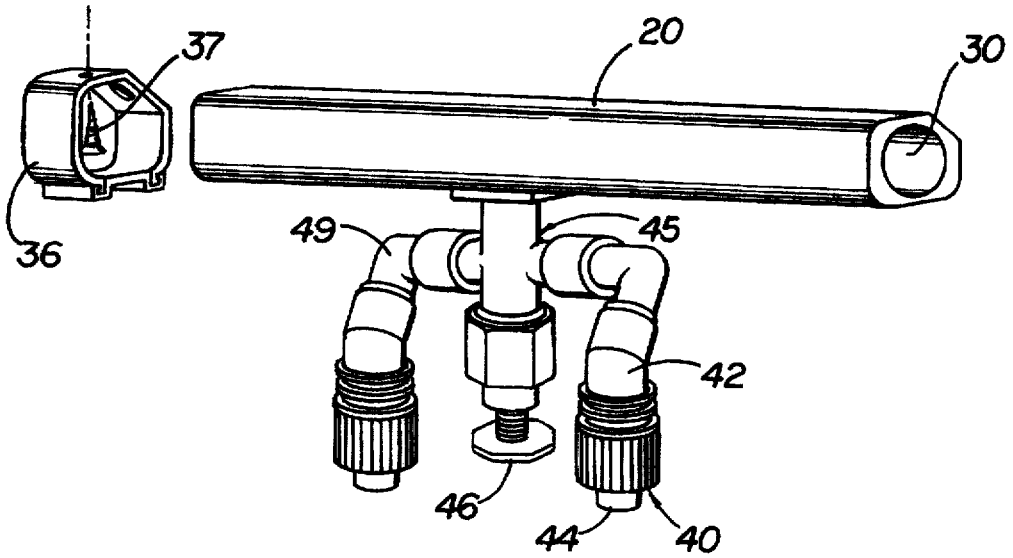
FIG. 3 is a perspective view of a portion of the present invention with a mounting bracket exploded away for clarity and showing the feed line presenting a "square" appearance with a downwardly depending spray station.
Figure 4:
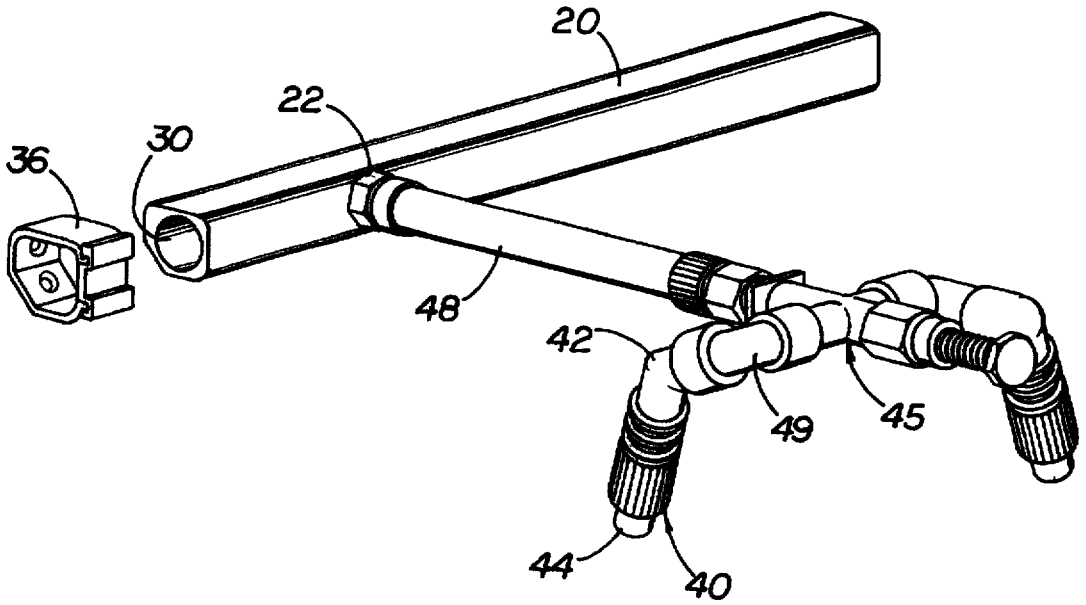
FIG. 4 is a perspective view of a portion of the present invention with a mounting bracket exploded away for clarity and showing the feed line presenting a "square" appearance with a forwardly directed spray station.

As shown in FIGS. 3 and 4, the feed line 20 can be mounted so that it presents a "square" appearance. The means to mount the feed line 20 includes a bracket 36 and mounting screw 37 or other means known in the art. The spray station 45 can be mounted in a downwardly depending position (FIG. 3) or in a forward or a rearward position (FIG. 4). If the spray station 45 is mounted in the forward position, it is less likely that spray from the spray nozzle 40 would contact a mirror disposed on the back of a produce or similar case in which the misting system 10 is used. If the spray contacts the mirror, the appearance of the produce case deteriorates over time from the water spots as well as the white mineral residue left when the water evaporates, which is also difficult to clean. When the spray station 45 is mounted in the rearward position adjacent the back of the case, then the spray should be carefully adjusted, such as by the valve stem 46, to ensure that it does not hit the mirror. In addition, the spray station arms 49 can be adjusted away for the mirror.

Figure 5:
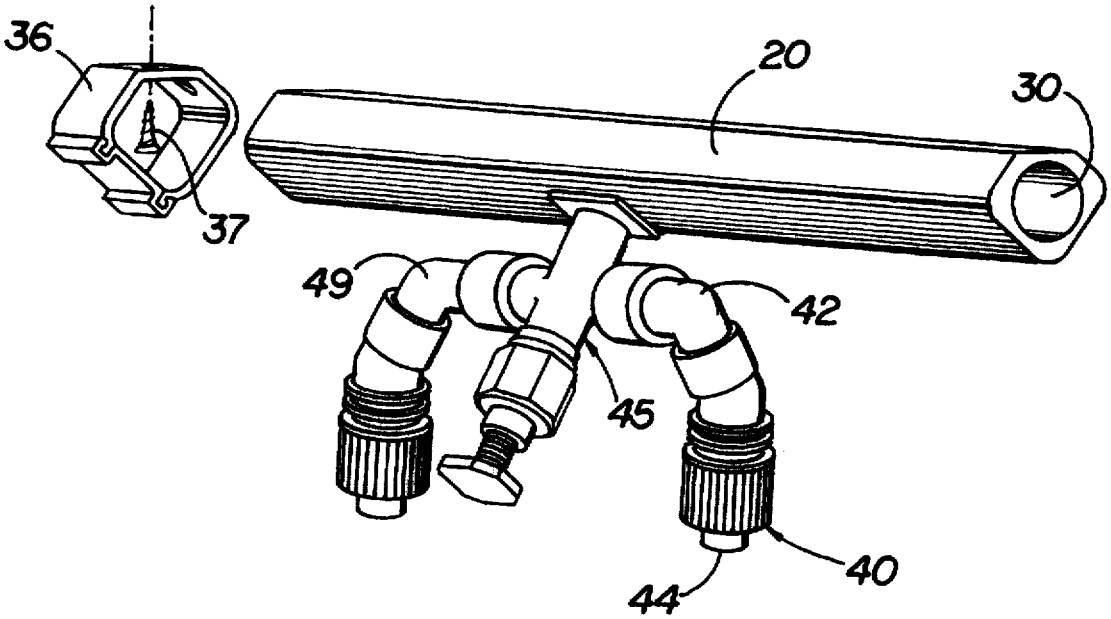
FIG. 5 is a perspective of a portion of the present invention with a mounting bracket exploded away for clarity and view showing the feed line presenting a "triangular" appearance with a forwardly directed spray station.
Figure 6:
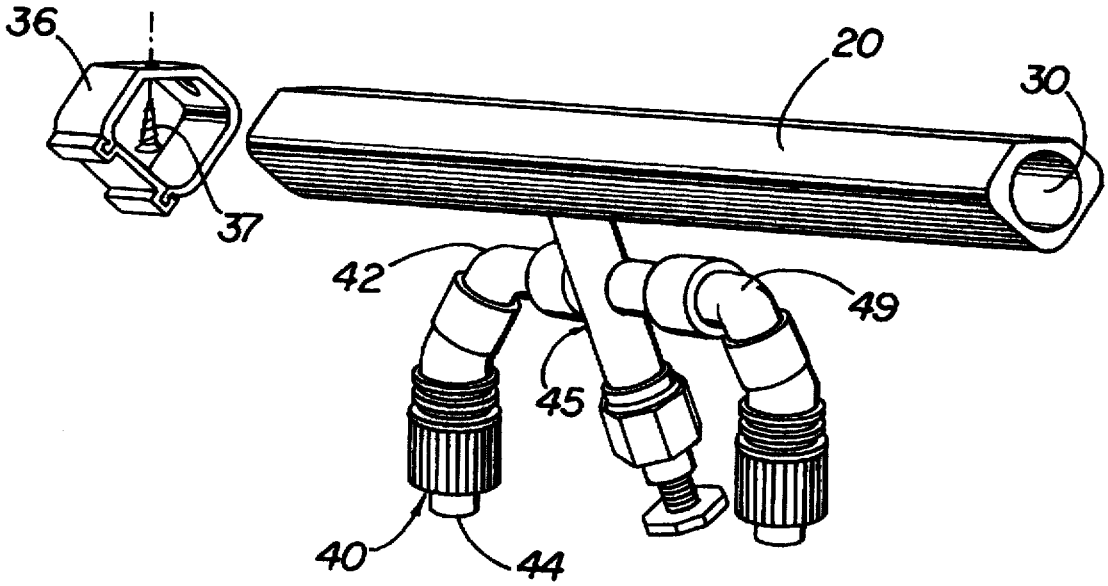
FIG. 6 is a perspective view of a portion of the present invention with a mounting bracket exploded away for clarity and showing the feed line presenting a "triangular" appearance with a rearwardly directed spray station.
Figure 7:
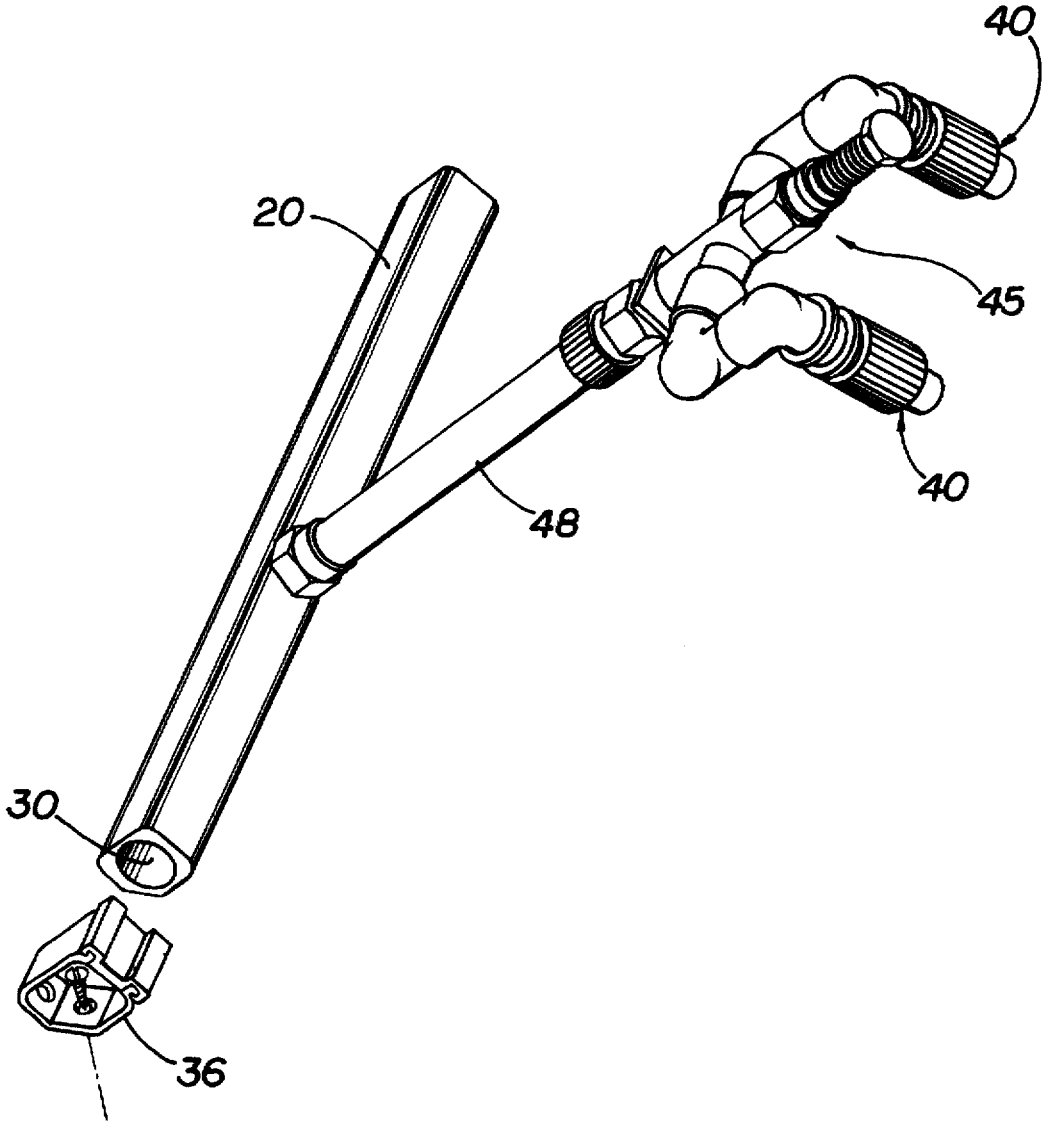
FIG. 7 is a perspective view of a portion of the present invention with a mounting bracket exploded away for clarity and showing the feed line presenting a "triangular" appearance as it could be mounted in an island case.

In comparison, the feed line 20 can also be mounted in a different position to have a "triangular" appearance. As with the square appearance, the spray station 45 can be mounted in the forward or the rearward position, which are shown in FIGS. 5 and 6, respectively. When the feed line 20 of the present invention in this configuration is mounted along the middle of an "island case" (stand alone case) or along the back side of a case that has no vertically-extending back wall, it has an advantage over prior art systems. As shown in FIG. 7, a spray station 45 is disposed in the feed line 20 at a forty-five degree (45°) angle so that the spray nozzles 40 can be positioned over the area that needs to be misted using a straight extension 48 when the mounting side 32 is parallel to the floor or bottom of the case. The extension 48 may be inserted between the spray station 45 and the feed line 20 in a desired increment, preferably not more than thirteen inches in length. And, spray stations 45 can be disposed on more than one display side 34 of the feed line 20 to spray both sides of an island case. It is clear that other systems, such as that disclosed in U.S. Pat. No. 4,914,339, cannot have spray nozzles or spray stations disposed in this manner to reach over the desired area to be sprayed.

Referring back to FIG. 1, the preferred controlling means 50 comprises a first, or main water supply, solenoid valve 52 disposed intermediate the supply 70 of the fluid and the feed line 20 so that the fluid flows therethrough. The controlling means 50 also comprises a second, or filter-flush, solenoid valve 54 having an inlet end 55 in fluid communication with the fluid that is downstream of the first solenoid valve 52 and an opposing outlet end 56. The outlet end 56 of the second solenoid valve 54 is in fluid communication with a drain 58. The means for moving the first and second solenoid valves 52, 54 is integrated in the timer 51.

It is also desirable to have a master shut-off valve 59 intermediate the supply 70 and the first solenoid valve 52, which is shown in FIG. 1 as a ball valve, as well as a pressure regulator (not shown). A filter system 60 is also desired in the present invention to protect the misting system 10 from damage and to prevent the spray nozzles 40 from clogging. The filter system 60 comprises a main filter screen 62 and a main filter housing 64. The filter screen 62 is a conventional cylindrical filter in which the fluid starts in the middle of a filter screen 62 so that the fluid must pass through the filter screen 62 and into the filter housing 64 and then into a supply line 57 located downstream of the filter screen 62. The supply line 57 is also connected to and in fluid communication with the feed line 20, as shown in FIG. 1.

The first solenoid valve 52 periodically or intermittently moves between a first open position to allow the fluid to flow to the spray nozzle 40 and then a first closed position to stop the fluid from flowing. The first solenoid valve 52 is controlled by a timer 51 which energies and de-energizes the first solenoid valve 52 to open and close. After the first solenoid valve 52 in the first closed position, pressurized fluid is left in the feed line 20. If the pressure of this fluid is not reduced, excessive dripping can occur from the spray nozzles 40. Thus, it is important to release or lower the pressure in the feed line 20 at the end of each spray cycle quickly. Accordingly, the second solenoid valve 54 moves to a second open position when the first solenoid valve 52 is in the first closed position so that the fluid that is pressurized downstream of the closed first solenoid valve 52 flows through and out of the outlet end 56 of the second solenoid valve 54 to reduce the pressure thereof This fluid travels from the outside of the filter screen 62 to the center and to the bottom of the filter housing 64. The fluid then travels out of the filter housing 64 via the second solenoid valve 54 and out of the drain 58. Thus, when the pressure is released after each cycle, the filter is flushed which eliminates the need to clean the filter screen 62 manually at frequent intervals. Therefore, the controlling means 50 allows continuous operation without the periodic requirement to stop the misting system 10 to clean the filter screen 62.

The timer 51 ensures that the second solenoid valve 54 moves to the second closed position before the first solenoid valve 52 opens again. Thus, the pressure in the misting system 10 rapidly increases so that there is minimum elapsed time before the spray of fluid exits the spray nozzles. It is desired that the timer 51 be adjustable so that the spray sequences can be varied to meet different misting requirements.

It is also advantageous to use a relatively large diameter for the bore 30 of the feed line 20 (e.g., 0.625 inches) and for the supply line 57 to assist in releasing pressure from the misting system 10 as rapidly as possible.

Although the present invention has been described with reference to specific details of certain embodiments thereof, it is not intended that such details should be regarded as limitations upon the scope of the invention except as and to the extent that they are included in the accompanying claims.

What is claimed is:

1. A feed line for a misting system that provides a spray of a fluid from a supply of the fluid through a spray nozzle having a fluid receiving end and a fluid dispensing end, the feed line comprising:

a hollow body portion having a first end adapted to be in fluid communication with the supply of the fluid, an opposite second end, and an exterior surface on the body portion, the body portion defining a longitudinally-extending bore through which the fluid flows, the body portion having at least one opening from the exterior surface into the bore in which the spray nozzle is disposed so that the fluid receiving end of the spray nozzle is in fluid communication with the fluid within the bore, and wherein at least a portion of the exterior surface is five-sided in which the five sides of the exterior surface are asymmetrically oriented about the bore.

2. The feed line of claim 1, wherein the bore of the feed line is circular.

3. The feed line of claim 1, wherein the five-sided exterior surface of the feed line comprises one mounting side and four display sides, wherein at least a portion of each of the four display sides is perpendicular to the adjacent display side.

4. The feed line of claim 3, wherein the mounting side is intermediate two display sides, the mounting side having two opposing ends, wherein each end of the mounting side terminates into the adjacent display side to form an obtuse angle therebetween.

5. A fluid delivery apparatus which is connected to a supply of fluid, comprising:

a. a feed line having a first end in fluid communication with the supply of the fluid, an opposite second end, and an exterior surface, the body portion defining a longitudinally-extending bore through which the fluid flows, wherein at least a portion of the exterior surface is five-sided in which the five sides of the exterior surface are asymmetrically oriented about the bore; and b. at least one spray nozzle having a fluid receiving end in fluid communication with fluid in the bore of the feed line and a fluid dispensing end through which the fluid sprays therefrom.

6. The apparatus of claim 5, wherein the bore of the feed line is circular.

7. The apparatus of claim 5, wherein the five-sided exterior surface of the feed line comprises one mounting side and four display sides, wherein at least a portion of each of the four display sides is perpendicular to the adjacent display side.

8. The apparatus of claim 7, wherein the mounting side is intermediate two display sides, the mounting side having two opposing ends, wherein each end of the mounting side terminates into the adjacent display side to form an obtuse angle therebetween.

9. The apparatus of claim 5, further comprising means for controlling the fluid flowing through the feed line so that the fluid sprays intermittently.

10. The apparatus of claim 9, wherein the controlling means comprises:

a. a first solenoid valve disposed intermediate the supply of the fluid and the feed line so that the fluid flows therethrough and being moveable between a first open position and a first closed position, wherein the first solenoid valve intermittently moves to the first open position to allow the fluid to flow to the spray nozzle and then moves to the first closed position to stop the fluid from flowing;

b. a second solenoid valve having an inlet end in fluid communication with the fluid that is downstream of the first solenoid valve and having an opposing outlet end and being moveable between a second open position and a second closed position, wherein the second solenoid valve is moved to the second open position when the first solenoid valve moves to the first closed position so that the fluid that is pressurized downstream of the closed first solenoid valve flows through and out of the outlet end of the second solenoid valve to reduce the pressure thereof and wherein the second solenoid valve moves to the second closed position before the first solenoid valve again moves to the first open position; and c. means for moving the first and second valves to the respective open and closed positions.

11. A misting system connected to a supply of a fluid, comprising:

a. a feed line having a first end in fluid communication with the supply of the fluid, an opposite second end, and an exterior surface, the body portion defining a longitudinally-extending bore through which the fluid flows, wherein at least a portion of the exterior surface is five-sided in which the five sides of the exterior surface are asymmetrically oriented about the bore;

b. at least one spray nozzle having a fluid receiving end in fluid communication with fluid in the bore of the feed line and a fluid dispensing end through which the fluid sprays therefrom; and c. means for controlling the fluid flowing through the feed line so that the fluid sprays intermittently.

12. The misting system of claim 11, wherein the bore of the feed line is circular.

13. The misting system of claim 11, wherein the five-sided exterior surface of the feed line comprises one mounting side and four display sides, wherein at least a portion of each of the four display sides is perpendicular to the adjacent display side.

14. The misting system of claim 13, wherein the mounting side is intermediate two display sides, the mounting side having two opposing ends, wherein each end of the mounting side terminates into the adjacent display side to form an obtuse angle therebetween.

15. The misting system of claim 11, wherein the controlling means comprises:

a. a first solenoid valve disposed intermediate the supply of the fluid and the feed line so that the fluid flows therethrough and being moveable between a first open position and a first closed position, wherein the first solenoid valve intermittently moves to the first open position to allow the fluid to flow to the spray nozzle and then moves to the first closed position to stop the fluid from flowing;

b. a second solenoid valve having an inlet end in fluid communication with the fluid that is downstream of the first solenoid valve and having an opposing outlet end and being moveable between a second open position and a second closed position, wherein the second solenoid valve is moved to the second open position when the first solenoid valve moves to the first closed position so that the fluid that is pressurized downstream of the closed first solenoid valve flows through and out of the outlet end of the second solenoid valve to reduce the pressure thereof and wherein the second solenoid valve moves to the second closed position before the first solenoid valve again moves to the first open position; and c. means for moving the first and second valves to the respective open and closed positions.

* * * * *